US010239721B2

(12) United States Patent
Yamaguchi et al.

(10) Patent No.: US 10,239,721 B2
(45) Date of Patent: Mar. 26, 2019

(54) SHEET CONVEYANCE APPARATUS CONTROLLING DIRECTION FOR CONVEYING SHEET, AND IMAGE FORMING APPARATUS

(71) Applicant: CANON KABUSHIKI KAISHA, Tokyo (JP)

(72) Inventors: Hideaki Yamaguchi, Susono (JP); Hiroharu Tsuji, Numazu (JP); Genki Takahashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/843,578

(22) Filed: Dec. 15, 2017

(65) Prior Publication Data

US 2018/0201459 A1 Jul. 19, 2018

(30) Foreign Application Priority Data

Jan. 18, 2017 (JP) ..... 2017-007004

(51) Int. Cl.
*B65H 29/60* (2006.01)
*B65H 7/14* (2006.01)
(Continued)

(52) U.S. Cl.
CPC ..... *B65H 29/60* (2013.01); *B65H 3/06* (2013.01); *B65H 5/068* (2013.01); *B65H 5/26* (2013.01); *B65H 5/36* (2013.01); *B65H 7/14* (2013.01); *B65H 29/58* (2013.01); *B65H 31/24* (2013.01); *G03G 15/6529* (2013.01);
(Continued)

(58) Field of Classification Search
CPC ... B65H 3/66; B65H 5/36; B65H 7/00; B65H 7/02; B65H 7/14; B65H 7/20; B65H 29/58; B65H 29/585; B65H 29/60; B65H 29/62; B65H 2404/63; B65H 2404/632; B65H 2404/65; B65H 2404/741; B65H 2404/7412; B65H 2404/7414; B65H 2515/30; B65H 2515/702; B65H 2555/13
See application file for complete search history.

(56) References Cited

U.S. PATENT DOCUMENTS 6,325,371 B1 * 12/2001 Araki ..... B65H 29/60 270/58.22
8,061,712 B2 11/2011 Tsuji et al.
(Continued)

FOREIGN PATENT DOCUMENTS

JP 2009-149385 A 7/2009
JP 2012-182318 A 9/2012

*Primary Examiner* — Prasad V Gokhale
(74) *Attorney, Agent, or Firm* — Venable LLP

(57) ABSTRACT

A sheet conveyance apparatus includes: a guide member configured to guide a sheet in a first direction in a first state, and in a second direction in a second state; a driving source configured to generate a driving force; a transfer member configured to change the state of the guide member from the first state to the second state by being moved by the driving force; and a control unit configured to control the driving force. The control unit is further configured to set the driving force to a value smaller than a force necessary to move the transfer member to change the guide member from the first state to the second state, and subsequently cause the driving force to increase to a value larger than the force necessary to move the transfer member.

13 Claims, 15 Drawing Sheets

(51) Int. Cl.

| | |
|---|---|
| ***B65H 3/06*** | (2006.01) |
| ***B65H 5/06*** | (2006.01) |
| ***G03G 15/00*** | (2006.01) |
| ***B65H 5/36*** | (2006.01) |
| ***B65H 5/26*** | (2006.01) |
| ***B65H 29/58*** | (2006.01) |
| ***B65H 31/24*** | (2006.01) |
| *B65H 1/04* | (2006.01) |
| *B65H 1/26* | (2006.01) |

(52) U.S. Cl.

CPC ..... *G03G 15/6541* (2013.01); *B65H 1/04* (2013.01); *B65H 1/266* (2013.01); *B65H 2404/632* (2013.01); *B65H 2404/7414* (2013.01); *B65H 2555/13* (2013.01); *B65H 2601/521* (2013.01); *B65H 2801/06* (2013.01); *G03G 2215/00864* (2013.01)

(56) References Cited

U.S. PATENT DOCUMENTS

| | | | | |
|---|---|---|---|---|
| 8,336,874 | B2 * | 12/2012 | Kato | B65H 3/0684 271/117 |
| 8,991,824 | B2 * | 3/2015 | Suzuki | G03G 15/234 271/265.01 |
| 2006/0127149 | A1 * | 6/2006 | Togashi | B65H 5/36 399/392 |
| 2014/0159303 | A1 * | 6/2014 | Suzuki | G03G 15/234 271/225 |

* cited by examiner

SHEET CONVEYANCE APPARATUS CONTROLLING DIRECTION FOR CONVEYING SHEET, AND IMAGE FORMING APPARATUS

BACKGROUND OF THE INVENTION

Field of the Invention

The present invention relates to a technique of switching a conveyance destination of a sheet.

Description of the Related Art

Japanese Patent Laid-Open No. 2012-182318 and Japanese Patent Laid-Open No. 2009-149385 disclose configurations for reducing a collision sound that arises in conjunction with an operation of a guide member when switching a conveyance destination of a sheet that is a recording sheet by the guide member.

In recent years, high-speed throughput in sheet conveyance and quietness of operational sounds of an apparatus have been requested more and more.

SUMMARY OF THE INVENTION

According to an aspect of the present invention, a sheet conveyance apparatus includes: a guide member configured to guide a sheet in a first direction in a first state, and guide the sheet in a second direction in a second state; a driving source configured to generate a driving force for changing a state of the guide member from the first state to the second state; a transfer member configured to change the state of the guide member from the first state to the second state by being moved by the driving force generated by the driving source; and a control unit configured to control the driving force of the driving source. The control unit is further configured to set the driving force of the driving source to a value smaller than a force necessary to move the transfer member to change the guide member from the first state to the second state, and subsequently cause the driving force of the driving source to increase to a value larger than the force necessary to move the transfer member.

Further features of the present invention will become apparent from the following description of exemplary embodiments with reference to the attached drawings.

DESCRIPTION OF THE EMBODIMENTS

Exemplary embodiments of the present invention will be described hereinafter, with reference to the drawings. Note, the following embodiments are examples and the present invention is not limited to the content of the embodiments. Also, for the following drawings, elements that are not necessary in the explanation of the embodiment are omitted from the drawings.

First Embodiment

Figure 1:
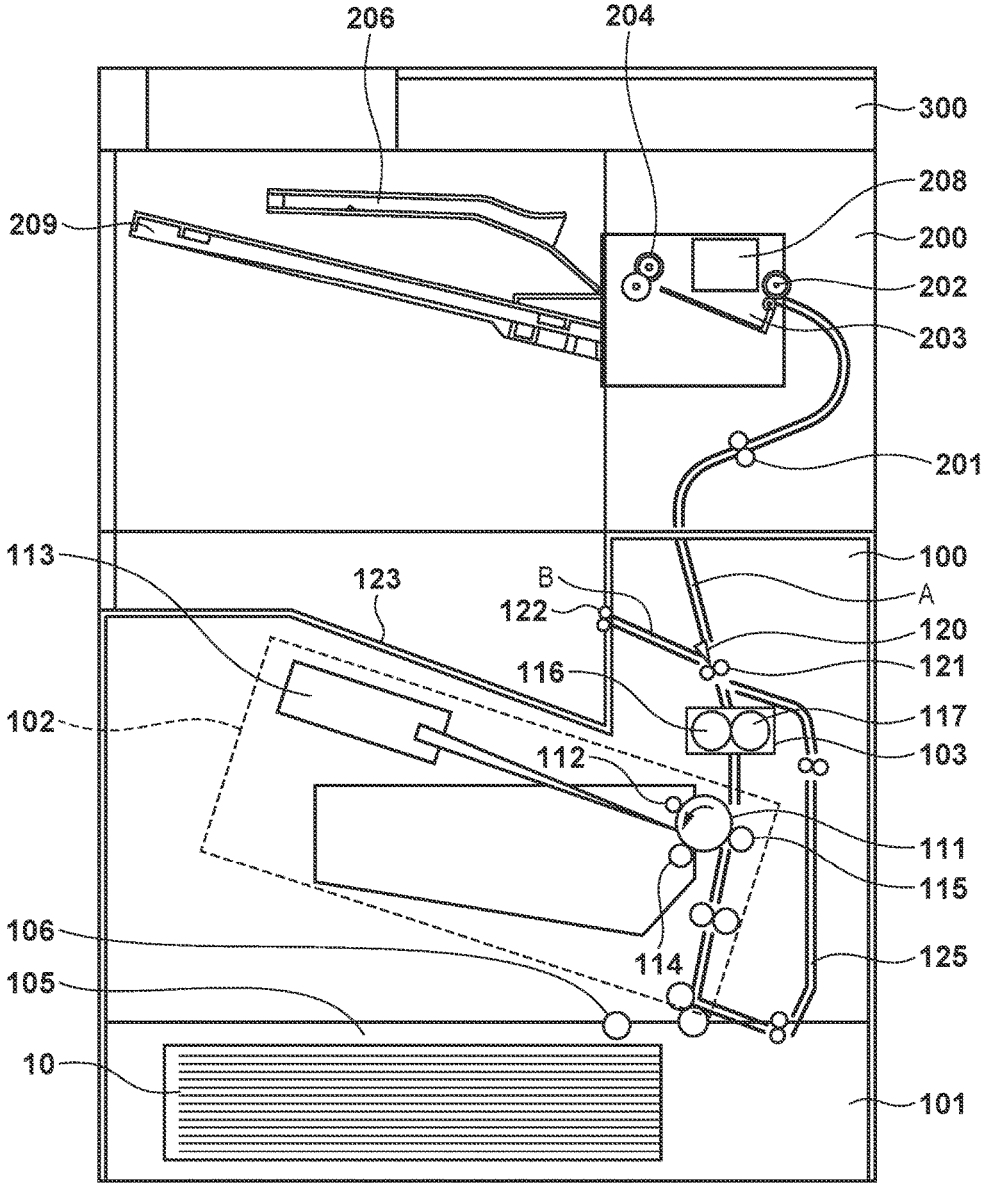
FIG. 1 is a configuration diagram of an image forming apparatus according to an embodiment.

FIG. 1 is a configuration view of an image forming apparatus 100 which is also a sheet conveyance apparatus. An image forming unit 102 of the image forming apparatus 100 forms a toner image on a photosensitive member 111, and transfers the image to a sheet 10 which is conveyed in a conveyance path. Specifically, at a time of image formation, the photosensitive member 111 is rotated in a direction of an arrow symbol in the drawing, and the surface thereof is charged to a uniform potential by a charging roller 112. An exposure unit 113 exposes the charged photosensitive member 111 by light, and forms an electrostatic latent image on the photosensitive member 111. A development unit 114 develops the electrostatic latent image of the photosensitive member 111 by toner, and forms a toner image on the photosensitive member 111. Meanwhile, the sheet 10 which is a target of the image formation is stored in a cassette 105 of a feed-conveyance unit 101. A feed roller 106 separates the sheet 10 from the cassette 105 one sheet at a time, and conveys the sheet 10 to a nip region between a transfer roller 115 and the photosensitive member 111. The transfer roller 115 outputs a transfer bias to transfer the toner image of the photosensitive member 111 to the sheet 10. The sheet 10 to which the toner image has been transferred is conveyed to a fixing unit 103. The fixing unit 103 has a fixing roller 116 and a pressure roller 117, and fixes the toner image to the sheet 10 by heating and pressurizing the sheet 10. In a case of forming images on both sides of the sheet 10, when a trailing edge of the sheet 10 reaches a pair of conveying rollers 121, the sheet 10 is guided to a re-feed path 125 by causing a reverse rotation of the pair of conveying rollers 121. By this, the sheet 10 is conveyed to the nip region between the photosensitive member 111 and the transfer roller 115 again, and image formation is performed on both sides of the sheet.

Out of sheets for which image formation has ended, a sheet that does not require post processing is conveyed in a conveyance path indicated by reference code B in FIG. 1 after passing the fixing unit 103. This is performed by setting a switching flapper 120 which is a guide member to a state in which the sheet 10 is directed to the conveyance path B. In this case, the sheet 10 is discharged to a discharge tray 123 by a pair of discharge rollers 122. Meanwhile, when performing post processing on the sheet 10, the sheet 10 is guided to a conveyance path indicated by reference code A in accordance with a state setting of the switching flapper 120, and by this the sheet 10 is conveyed to a post-processing apparatus 200. In the following explanation, a state of the switching flapper 120 that is set so the sheet 10 is caused to be directed to the conveyance path B is referred to as a state B, and a state of the switching flapper 120 that is set so that the sheet 10 is caused to be directed to the conveyance path A, in other words the post-processing apparatus 200, is referred to as a state A.

The sheet 10 conveyed directed to the conveyance path A is conveyed to an intermediate stacking unit 203 by pairs of conveying rollers 201 and 202. When a predetermined number of the sheets 10 that are in accordance with a print job stacked in the intermediate stacking unit 203, an alignment unit 206 causes this plurality of the sheets 10 to align, and a stapler 208 performs binding processing of this plurality of the sheets 10. The bound sheets 10 are discharged to a stacking tray 209 by a discharging roller pair 204. The post-processing apparatus 200 of the present embodiment may perform binding processing, but the content of post processing is not limited to binding processing. Note that the image forming apparatus 100 is provided with an image reading apparatus 300 for reading an image of an original. The image forming apparatus 100 of the present embodiment can form on a sheet 10 an image of an original read by the image reading apparatus 300, and can also perform image formation based on image data received via a network or an external apparatus.

Figure 2A:
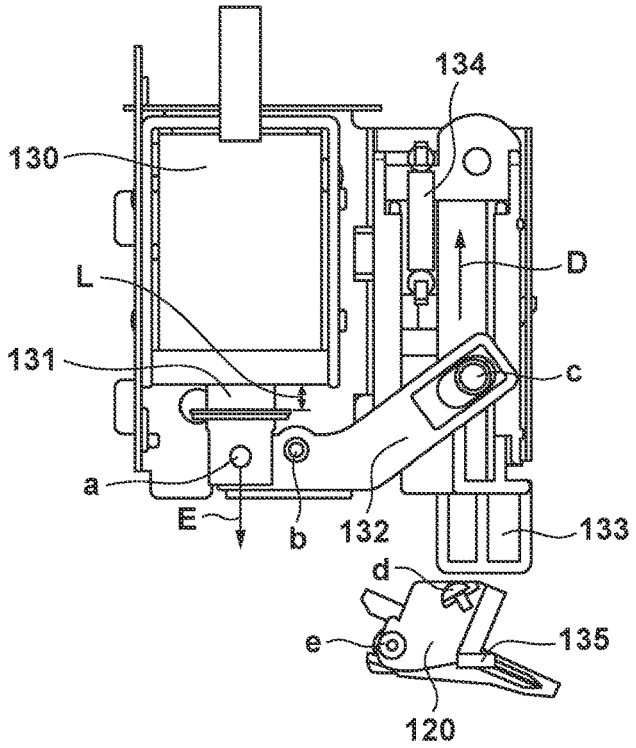
FIG. 2A and FIG. 2B are explanatory views of states of a switching flapper in accordance with an embodiment.

FIG. 2A is a view that illustrates a switching configuration of the switching flapper 120. A solenoid 130 is a driving source of the switching flapper 120, and has a plunger 131 as a movable portion. A first link member 132 is connected to the plunger 131 by a connection portion a, and is configured to rotate centered on a supporting point b. A second link member 133 is engaged with respect to a hole of the first link member 132 by a boss at a connection portion c, and is configured to slide in a vertical direction of the view. A spring 134 is attached to the second link member 133. When the second link member 133 presses down a pressing portion d of the switching flapper 120 in accordance with operation of the solenoid 130, the switching flapper 120 rotates centered on a supporting point e. However, a rotation operation of the switching flapper 120 is restricted by a stopper 135.

Figure 4:
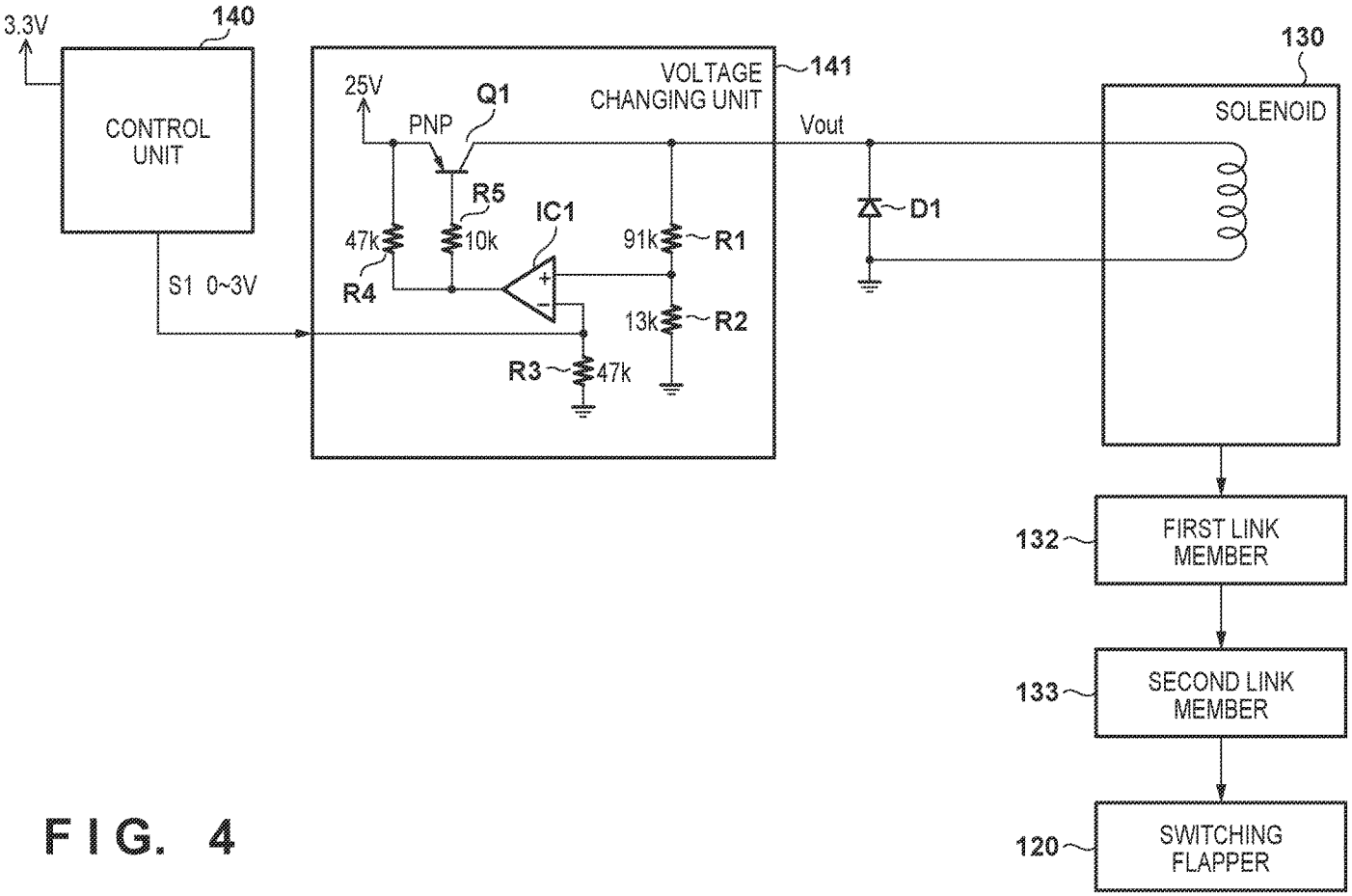
FIG. 4 is a view illustrating a switching control configuration of the switching flapper in accordance with an embodiment.

FIG. 4 is a view that illustrates a switching control configuration of the switching flapper 120. A control unit 140 controls the image forming apparatus 100 overall. A voltage changing unit 141 applies a voltage Vout, which is in accordance with a voltage of a signal S1 inputted from the control unit 140, to the solenoid 130. In the present embodiment, the voltage of the signal S1 is within the range of 0V through 3V. Note that a diode D1 is a diode for current regeneration of the solenoid 130. By applying a voltage to the solenoid 130, a driving force (attraction in the present example) arises in the solenoid 130. The driving force moves the first link member 132 and the second link member 133 which are transfer members, and by this switching of the state of the switching flapper 120 is performed.

The voltage changing unit 141 is configured by a PNP transistor Q1, an operational amplifier IC1, and a resistor R1 through a resistor R5. In FIG. 4, the resistor R1 is 91 kΩ, the resistor R2 is 13 kΩ, the resistor R3 and the resistor R4 are 47 kΩ, and the resistor R5 is 10 kΩ. When the signal S1 is inputted to an inverted input terminal of the operational amplifier IC1, the operational amplifier IC1 causes its output to change so that the voltage of the non-inverted input terminal has the same value as a voltage VS1 of the signal S1. In such a case, Vout outputted by the voltage changing unit 141 is as Equation (1) below.

$$Vout = VS1 \times (R1 + R2)/(R2) = VS1 \times 8[V] \quad (1)$$

Figure 5:
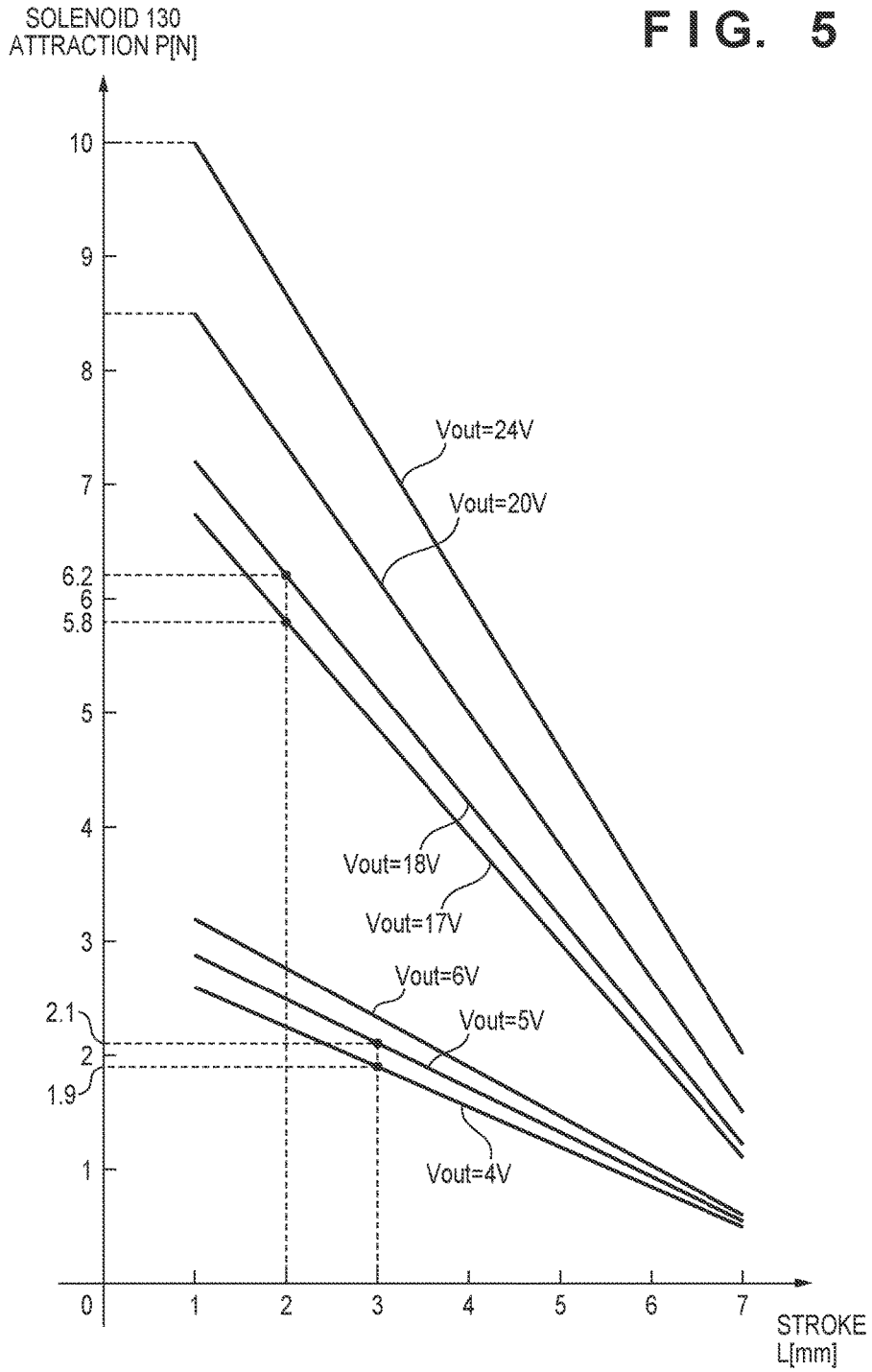
FIG. 5 is a view that illustrates a relation between a stroke and an attraction of a solenoid in accordance with an embodiment.

Next, explanation is given regarding an attraction P of the solenoid 130. The attraction P of the solenoid 130 is related to a stroke L of the plunger 131, as illustrated in FIG. 5. Here, the stroke L of the plunger 131 is, as illustrated in FIG. 2A, a movement amount of the plunger 131 toward a bottom side of the view from outer frame of the solenoid 130 (yoke). Note that the relation between the stroke L and the attraction P is actually a gentle curve, but in the embodiment below it is handled as approximating a linear function. As illustrated in FIG. 5, the attraction P increases as the stroke L decreases. This is because, the smaller the stroke L is, the more the plunger 131 is influenced by a magnetic field generated by the solenoid 130.

In addition, the attraction P changes in accordance with the applied voltage Vout with respect to the windings of the solenoid 130. In FIG. 5, the attraction P of the solenoid 130 in cases where Vout is 4V, 5V, 6V, 17V, 18V, 20V, and 24V is respectively illustrated in the graph. That the attraction P increases as Vout increases is because current flowing in the windings of the solenoid 130 increases and the magnetic field that is generated becomes stronger.

Figure 6:
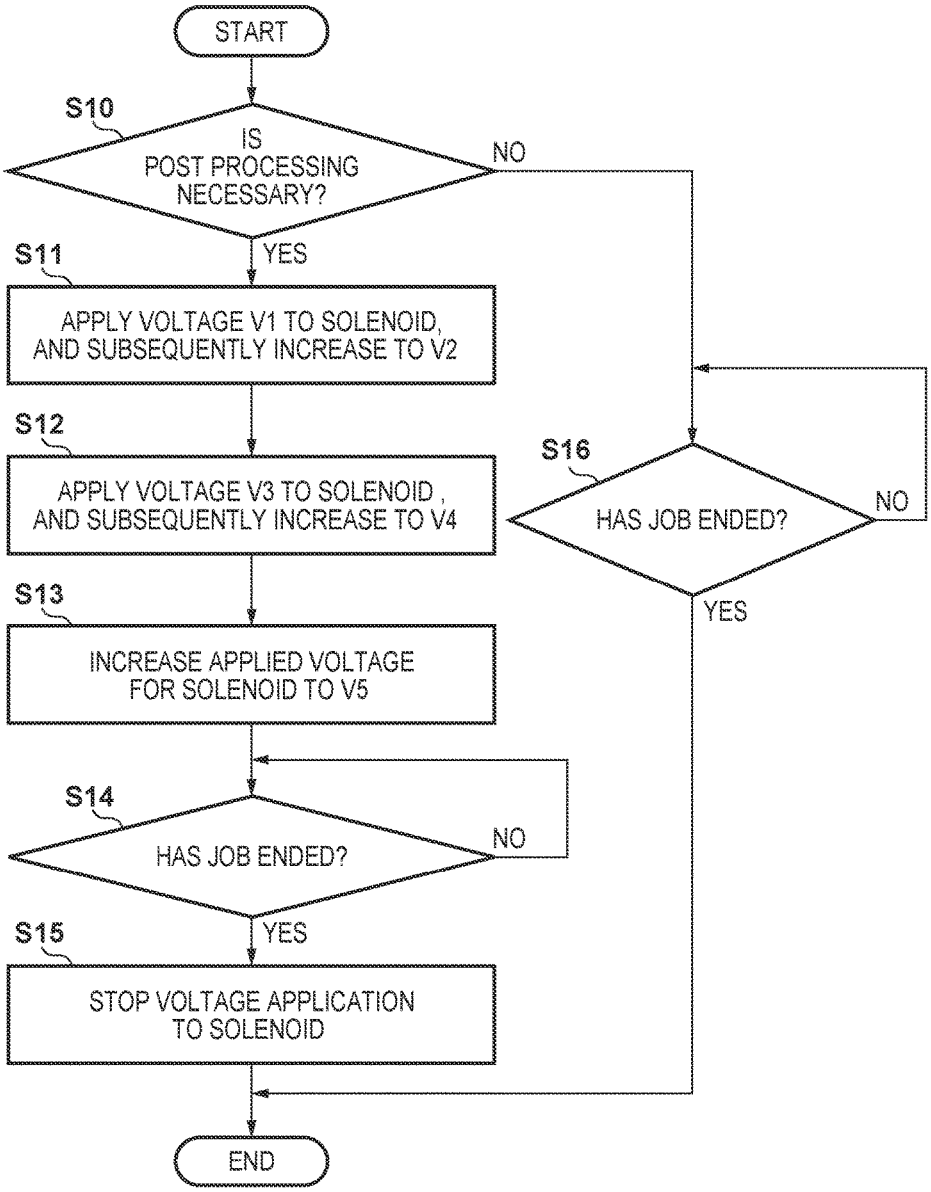
FIG. 6 is a flowchart for sheet conveyance processing in accordance with an embodiment.

FIG. 6 is a flowchart for sheet conveyance processing according to this embodiment. Note that, in an initial state, the control unit 140 has stopped output of the signal S1—in other words the signal S1 is 0V. FIG. 2A illustrates the state in such a case. In FIG. 2A, in accordance with the self weight of the plunger 131, a force in the direction of an arrow symbol E is applied to the plunger 131. Furthermore, by a pulling force of the spring 134, the second link member 133 is pulled in a direction of the arrow symbol D. In other words, in FIG. 2A, by the two forces of the self weight of the plunger 131 and the pulling force of the spring 134, the second link member 133 is pulled in the direction of an arrow symbol D. Note that, in the present example, the stroke L is L=3 mm. In addition, at this point the switching flapper 120 enters the state B. Note that it is assumed that the switching flapper 120 of the present embodiment enters the state A when pressed down by the second link member 133, and is in the state B when not being pressed down by the second link member 133. In addition, in the present example, let an attraction F1 of the solenoid 130 necessary to move the second link member 133 toward the bottom side of FIG. 2A be 2N, and let an attraction F2 of the solenoid 130 necessary to move the switching flapper 120 be 6N.

Upon receiving a print job from a user, the image forming apparatus 100 starts processing illustrated in FIG. 6. In step S10, the control unit 140 determines whether post processing has been designated in the print job. As described above, in an initial state, the switching flapper 120 is in the state B. Accordingly, when post processing is unnecessary, in step S16 the control unit 140 forms an image designated in the print job on a sheet 10, and when the image formation designated by the print job completes, the processing of FIG. 6 ends.

Meanwhile, when it is determined in step S10 that post processing is necessary, the control unit 140, as described below, performs processing for switching the switching flapper 120 from the state B to the state A. Firstly, in step S11, the control unit 140 sets the applied voltage Vout with respect to the solenoid 130 to V1, and subsequently causes it to increase to V2. Here, letting the attraction of the solenoid when the applied voltage Vout for the solenoid 130 is V1 be P1 and the attraction of the solenoid when the applied voltage Vout for the solenoid 130 is V2 be P2, a relation between P1, P2, F1, and F2 is as follows.

$$P1<F1<P2<F2$$

Note that, as described above, F1 is the attraction of the solenoid 130 necessary to move the second link member 133 toward the bottom side of FIG. 2A. In addition, F2 is the attraction of the solenoid 130 necessary to move the switching flapper 120.

In the present example, V1 is set to 4V and V2 is set to 6V. Accordingly, by the above Equation (1), the control unit 140 firstly sets the voltage of the signal S1 to 0.5V. By this, the applied voltage for the solenoid is 4V which is V1. Because the stroke L is 3 mm in the initial state, in accordance with FIG. 5, the attraction P1 of the solenoid 130 at this point is 1.9N which is less than F1=2N. Accordingly, the second link member 133 does not move, and the switching flapper 120 remains in the state of FIG. 2A. The control unit 140 changes the voltage of the signal S1 to 0.625V 20 ms after setting the applied voltage for the solenoid 130 to 4V. By this, the applied voltage for the solenoid 130 becomes 5V. By FIG. 5, the attraction P2 of the solenoid 130 at this point becomes 2.1N. Accordingly, because the attraction of the solenoid 130 exceeds 2N which is the force necessary to move the second link member 133, the switching flapper 120 transitions to the state illustrated in FIG. 2B. In other words, the plunger 131 is pulled in the direction of an arrow symbol F, and force is applied to the connection portion c of the first link member 132 in a direction of an arrow symbol G. By this, the second link member 133 moves in the direction of an arrow H, and abuts the pressing portion d of the switching flapper 120. Note that, in the present example, it is assumed that the stroke L is 2 mm when the second link member 133 abuts the pressing portion d of the switching flapper 120. As illustrated in FIG. 5, by the stroke L decreasing, the attraction P2 of the solenoid 130 increases from 2.1N to 2.5N. However, because this is less that F2=6N, the force necessary to press down the switching flapper 120, the second link member 133 cannot press the switching flapper 120 down and remains in the state illustrated in FIG. 2B. Note that at this point the switching flapper 120 remains in the state B. When 20 ms have passed after 5V are applied to the solenoid 130, the control unit 140 changes the signal S1 to 0.75V. By this, the applied voltage for the solenoid 130 is 6V which is V2. However, the attraction P of the solenoid 130 is smaller than 6N, and the switching flapper 120 remains in the state B.

Next, in step S12, the control unit 140 sets the applied voltage Vout with respect to the solenoid 130 to V3, and subsequently causes it to increase to V4. Here, letting the attraction of the solenoid when the applied voltage Vout for the solenoid 130 is V3 be P3 and the attraction of the solenoid when the applied voltage Vout for the solenoid 130 is V4 be P4, a relation between P3, P4, and F2 is as follows.

$$P3<F2<P4$$

Note that F2 is the attraction of the solenoid 130 necessary to move the switching flapper 120.

In the present example, V3 is set to 16V and V4 is set to 20V. Accordingly, by the above Equation (1), the control unit 140 firstly sets the voltage of the signal S1 to 2V. By this, the applied voltage for the solenoid is 16V which is V3. Next, when 20 ms have passed after the applied voltage for the solenoid 130 is set to 16V, the control unit 140 changes the signal S1 to 2.125V. That is, the applied voltage for the solenoid 130 changes to 17V. At this point, as illustrated in FIG. 5, the attraction P of the solenoid 130 is 5.8V, which is less than F2=6N which is the force necessary to press the switching flapper 120 down. Accordingly, the switching flapper 120 remains in the state B illustrated in FIG. 2B.

Figure 3:
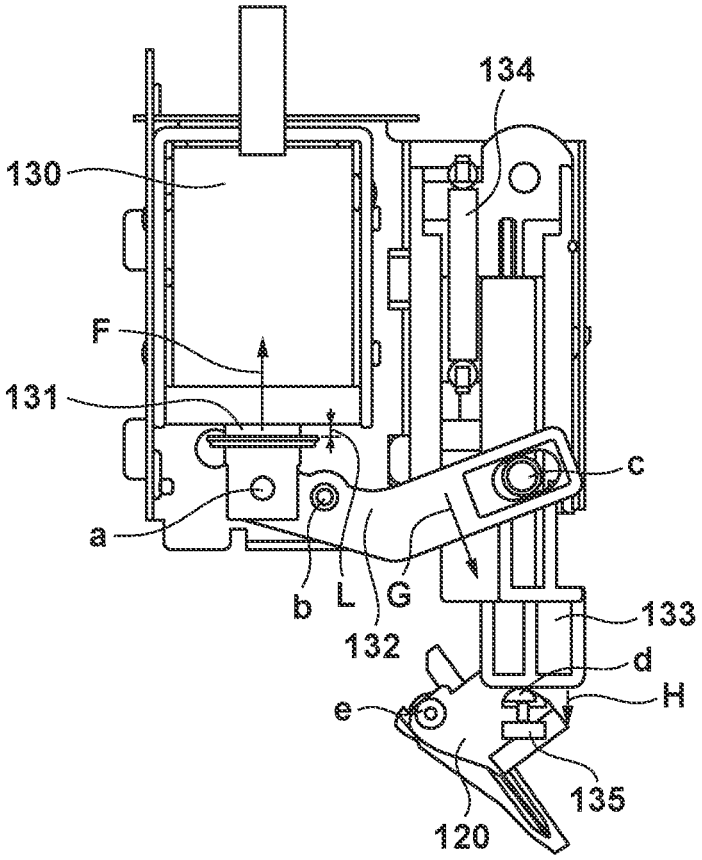
FIG. 3 is an explanatory view of a state of the switching flapper in accordance with an embodiment.

When 20 ms elapse, the control unit 140 changes the signal S1 to 2.25V, and with this the applied voltage for the solenoid 130 becomes 18V. As illustrated in FIG. 5, the attraction P of the solenoid 130 at this point is 6.2N, which exceeds the necessary 6N to press the switching flapper 120 down, and thus the switching flapper 120 is pressed down, and transitions to the state illustrated in FIG. 3. In other words, the plunger 131 is pulled in the direction of the arrow symbol F, and the connection portion c of the first link member 132 moves in the direction of the arrow symbol G. Accordingly, the second link member 133 moves in the direction of an arrow H to push the pressing portion d of the switching flapper 120, and the switching flapper 120 rotates centered on the supporting point e. Note that, when the pressing portion d abuts the stopper 135, the switching flapper 120 stops and enters the state of FIG. 3. At this point the switching flapper 120 enters the state A. Note that, in the present example, it is assumed that the stroke L at the time of the state of FIG. 3 is 1 mm. Subsequently, the control unit 140 gradually changes the voltage of the signal S1 to 2.375V and then to 2.5V. In other words, the control unit 140 changes the applied voltage for the solenoid 130 to 19V, and further changes the applied voltage to 20V which is V4. Note that, because the pressing portion d of the switching flapper 120 abuts the stopper 135, the state of FIG. 3 is maintained even if the applied voltage for the solenoid is increased.

Subsequently, in step S13, the control unit 140 causes the applied voltage for the solenoid 130 to increase to V5. In the present embodiment, V5 is 24V which is the maximum output voltage of the voltage changing unit 141. This is to increase the attraction P of the solenoid 130 so that the switching flapper 120 does not move even if the switching flapper 120 is pressed by the sheet 10 being conveyed.

When the applied voltage of the solenoid 130 is set to V5, in step S14, the control unit 140 performs the image formation designated by the print job, and the post processing by the post-processing apparatus 200. When the processing designated by the print job completes, the control unit 140 changes the signal S1 to 0V. That is, it sets the applied voltage for the solenoid 130 to 0V. By this, the attraction P of the solenoid 130 becomes zero, and the switching flapper 120 switches back to the state B.

Figure 7:
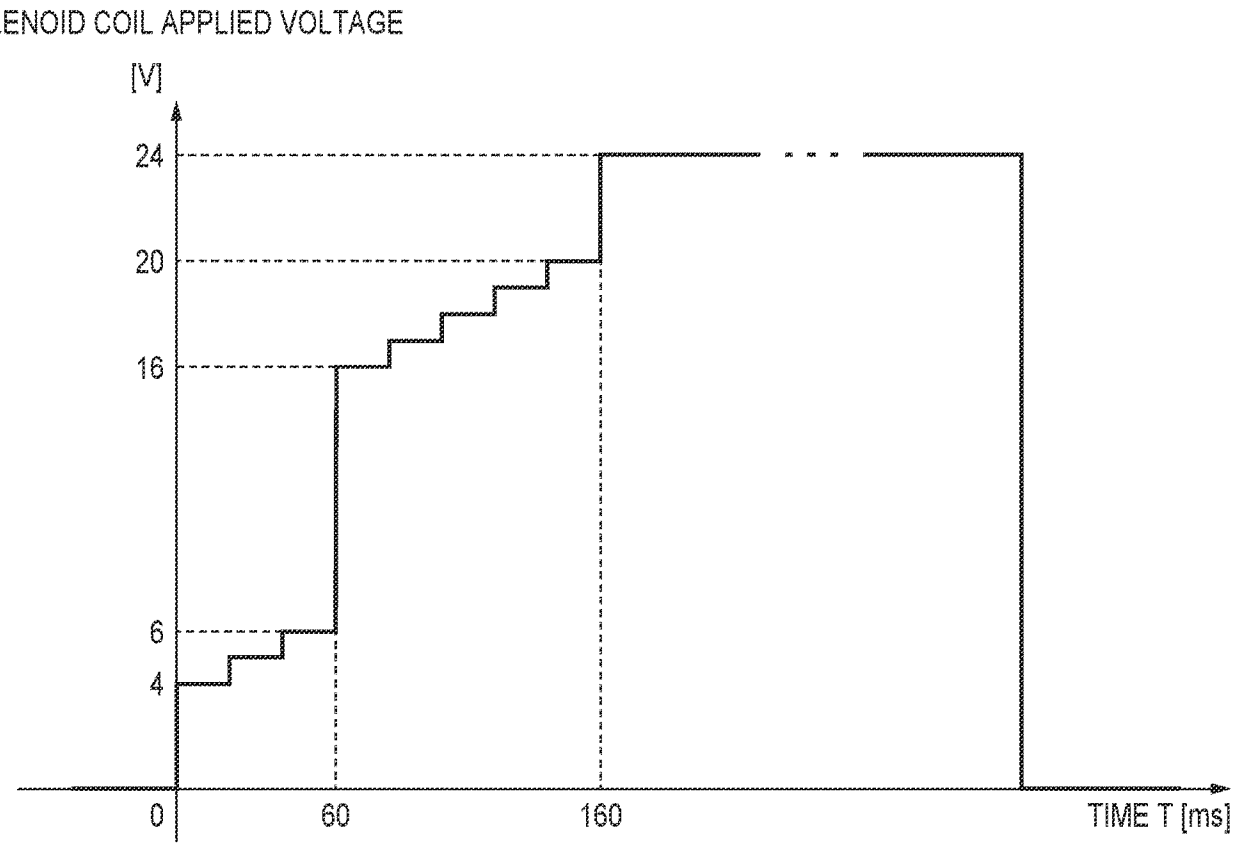
FIG. 7 is a view that illustrates an applied voltage for a solenoid in the sheet conveyance processing in accordance with an embodiment.

FIG. 7 illustrates the relation between time and the applied voltage for the solenoid 130 that was explained with reference to FIG. 6. Note that the applied voltages of 4, 6, 16, 20, and 24V illustrated in FIG. 7 respectively correspond to V1, V2, V3, V4, and V5. Note that waiting for only 20 ms when changing the applied voltage is in consideration of the amount of time necessary to transition between the states of FIG. 2A and FIG. 2B, and from the state of FIG. 2B to the state of FIG. 3. In other words, the wait period (20 ms in the present example) is an amount of time that is larger than the amount of time necessary to transition between the states of FIG. 2A and FIG. 2B, and from the state of FIG. 2B to the state of FIG. 3.

Thus, in the present embodiment, when switching the switching flapper 120, firstly the attraction P of the solenoid 130 is set to a force smaller than a force necessary to move the second link member 133. Subsequently, the attraction P of the solenoid 130 is caused to gently increase to a force larger than the force necessary to move the second link member 133. By this, it is possible to soften the impact when the second link member 133 bumps into the pressing portion d. Furthermore, the attraction P of the solenoid 130 is caused to gently transition from a value by which it is not possible to press the switching flapper 120 down to a value by which it is possible to press the switching flapper 120 down. Accordingly, it is possible to soften the impact of the switching flapper 120 bumping to the stopper 135. Note that, in the present embodiment, the attraction of the solenoid is caused to increase gradually (by 1V at a time), but configuration may be taken to cause the attraction to increase continuously. Note that it is possible to soften the impact by setting the attraction P1 to a value that is smaller than F1 and as close to F1 as possible, and setting the attraction P2 to a value that is larger than F1 and as close to F1 as possible. However, decisions for the attraction P1 and the attraction P2 must consider variation due to individual members. Accordingly, in the present embodiment, with consideration given to variation due to individual members, the attraction is set to a force less than the force necessary to move the second link member 133, and then the attraction is caused to increase to a force greater than the force necessary to move the second link member 133.

<Variation>

Figure 8:
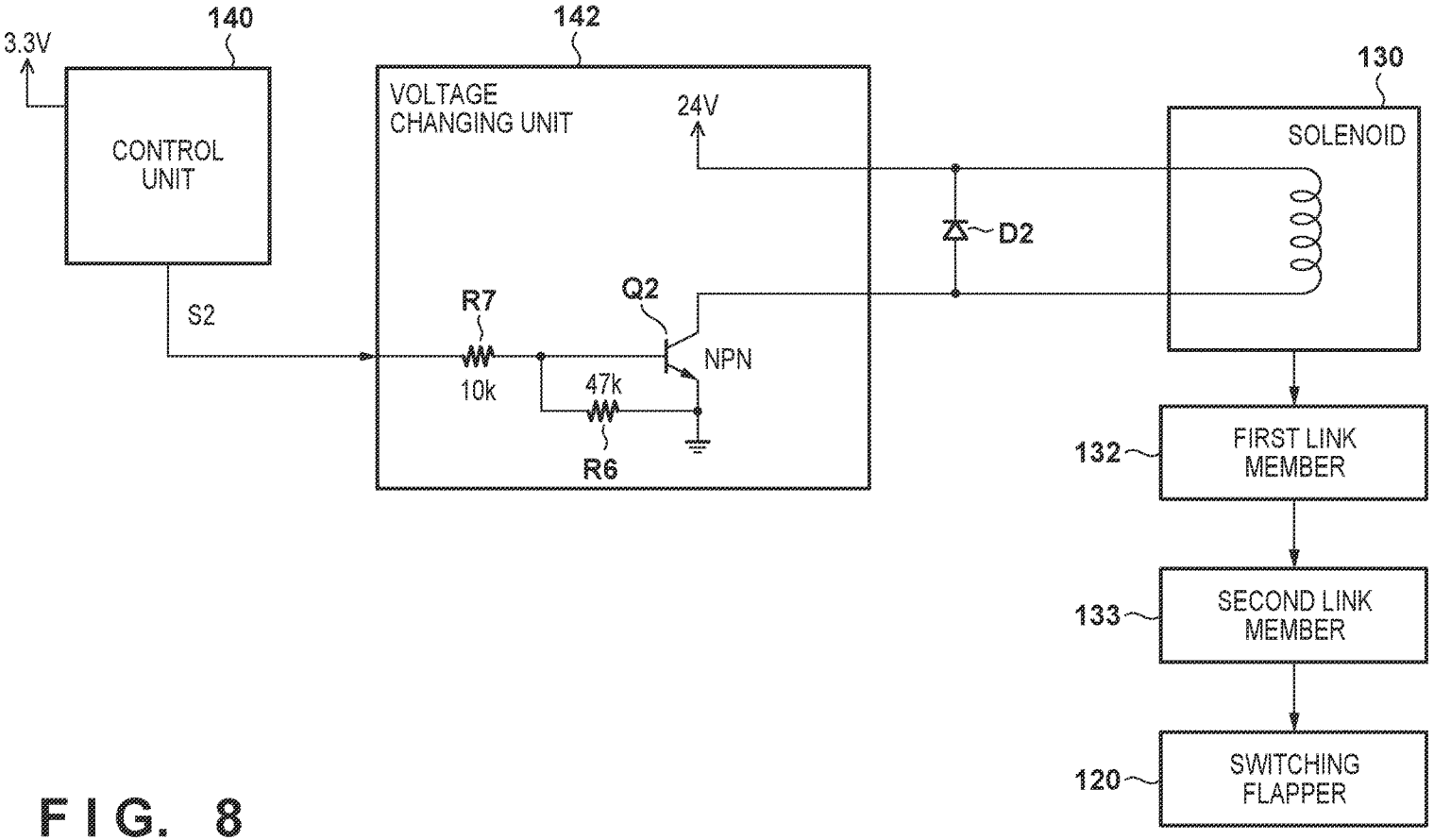
FIG. 8 is a view illustrating a switching control configuration of the switching flapper in accordance with an embodiment.
Figure 9:
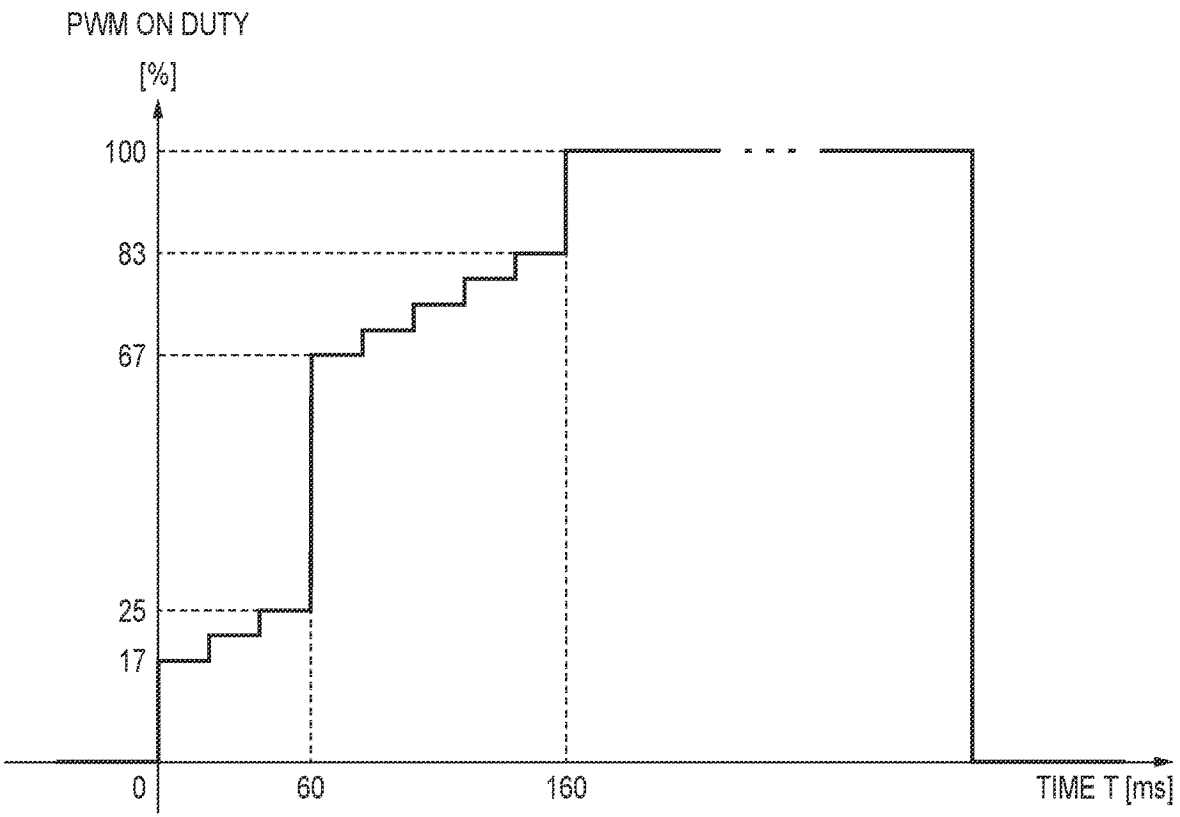
FIG. 9 is a view that illustrates an applied voltage for a solenoid in the sheet conveyance processing in accordance with an embodiment.

FIG. 8 illustrates another configuration of a voltage changing unit as a voltage changing unit 142. In the present variation, the voltage changing unit 142 generates an applied voltage for the solenoid 130 in accordance with a signal S2 inputted from the control unit 140. The control unit 140 outputs as the signal S2 either of a high output (3.3V) or a low output (0V). The voltage changing unit 142 is configured by an NPN transistor Q2, a resistor R6, and a resistor R7. In the present example, let the resistor R6 be 47 kΩ, and let the resistor R7 be 10 kΩ. A diode D2 is provided for a purpose of causing a current in accordance with a counter-electromotive voltage of the winding of the solenoid 130 to regenerate. When the signal S2 outputted by the control unit 140 is high (3.3V), the voltage changing unit 142 outputs 24V, and when the signal S2 is low (0V), the voltage changing unit 142 outputs 0V. However, in the present embodiment, the signal S2 is a pulse width modulation (PWM) signal of a predetermined frequency (for example, 15 kHz). In other words, it is approximately equivalent to a direct-current voltage in accordance with the on duty ratio of the PWM signal being applied to the solenoid 130. Specifically, when the on duty ratio is 50% it is equivalent to the applied voltage for the solenoid 130 being 12V, and when the on duty ratio is 75% it is equivalent to the applied voltage for the solenoid 130 being 18V. FIG. 9 illustrates, by on duty ratios of the PWM signal, the voltages V1, V2, V3, V4, and V5 explained by FIG. 6.

Second Embodiment

Figure 10:
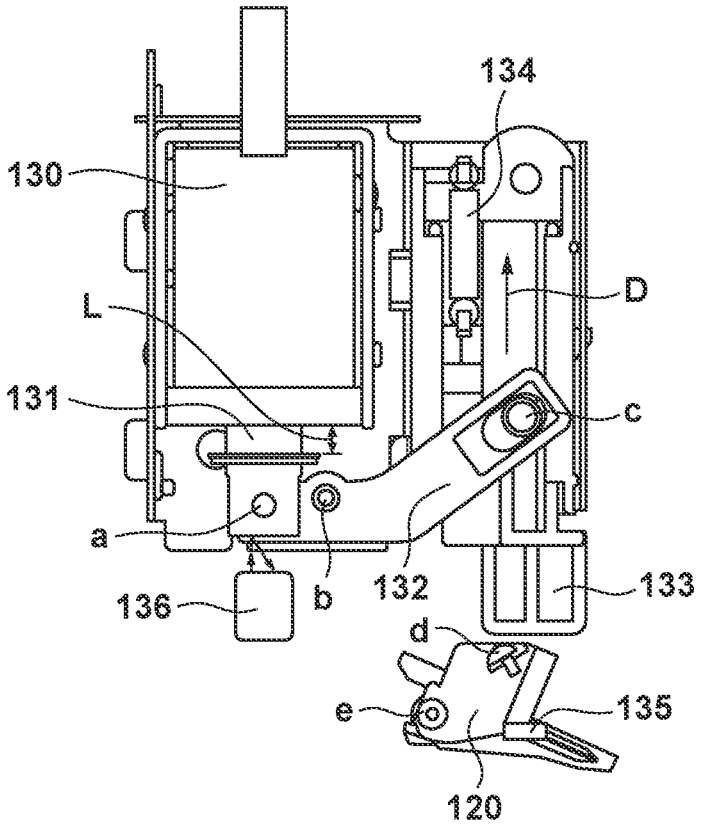
FIG. 10 is a view illustrating a switching configuration of the switching flapper in accordance with an embodiment.
Figure 11:
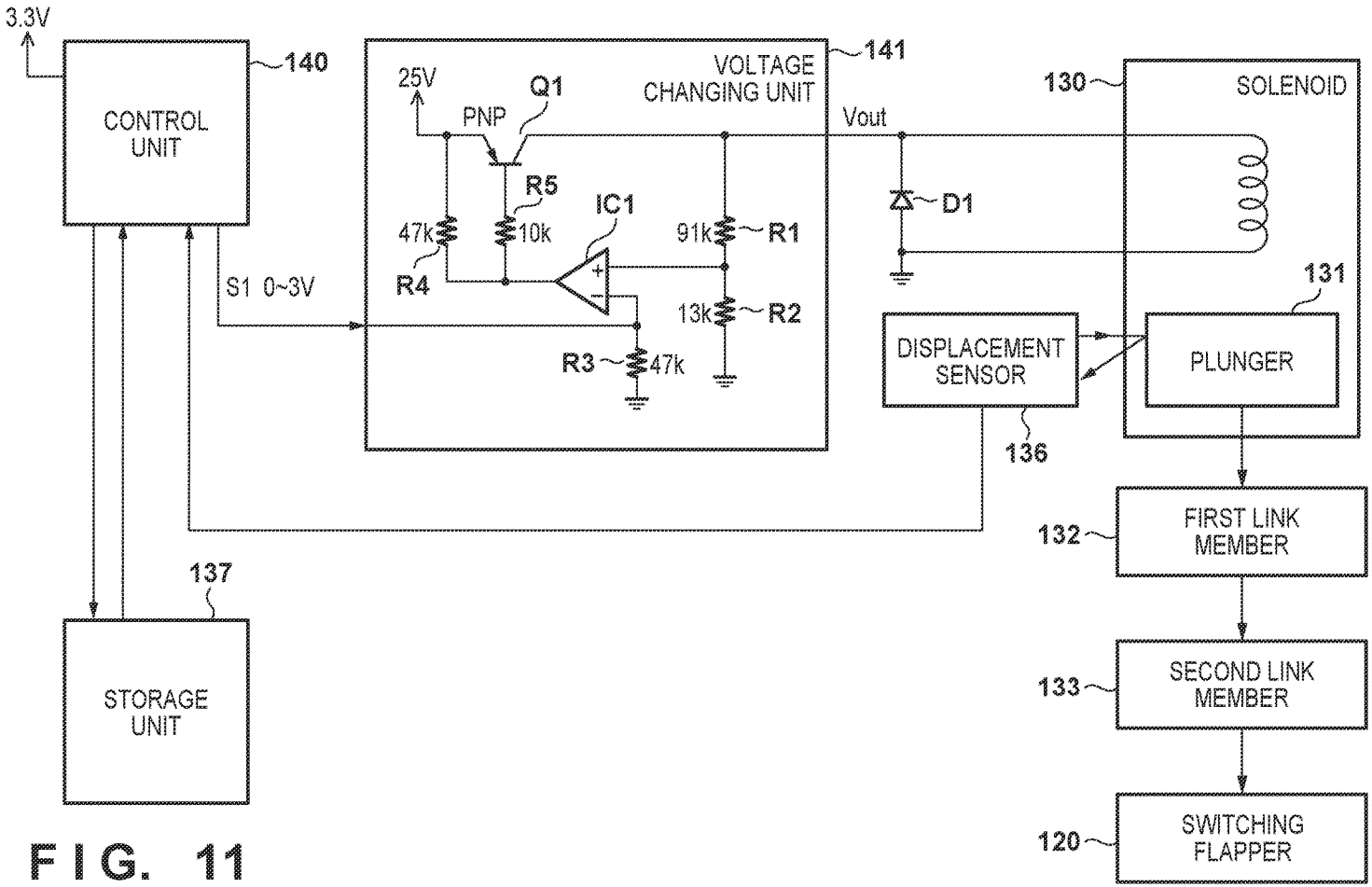
FIG. 11 is a view illustrating a switching control configuration of the switching flapper in accordance with an embodiment.

Subsequently, description is given regarding the second embodiment focusing on points of difference with the first embodiment. FIG. 10 illustrates a switching configuration of the switching flapper 120 according to this embodiment. In the present embodiment, a displacement sensor 136 for measuring/detecting a displacement amount (a movement amount) of the plunger 131 is added to the switching configuration of the first embodiment. Note that, in the present embodiment, it is assumed that the displacement sensor 136 is optical, but the displacement sensor 136 may be another type of displacement sensor such as an ultrasonic wave displacement sensor. FIG. 11 illustrates a control configuration of the switching flapper 120 according to this embodiment. As illustrated in FIG. 11, in the present embodiment, the displacement sensor 136 transmits a detection result to the control unit 140. In addition, a storage unit 137 for the control unit 140 to hold data is provided.

In the present embodiment, it is also assumed that the stroke L is 3 mm in the initial state, as explained using FIG. 2A. Furthermore, assume that the stroke L is 2 mm when the second link member 133 abuts the pressing portion d of the switching flapper 120. Furthermore, it is assumed that the stroke L is 1 mm when the pressing portion d abuts the stopper 135. Furthermore, it is assumed that the relation between the stroke L, the applied voltage for the solenoid 130, and the attraction P of the solenoid 130 is as illustrated in FIG. 5.

Figure 12:
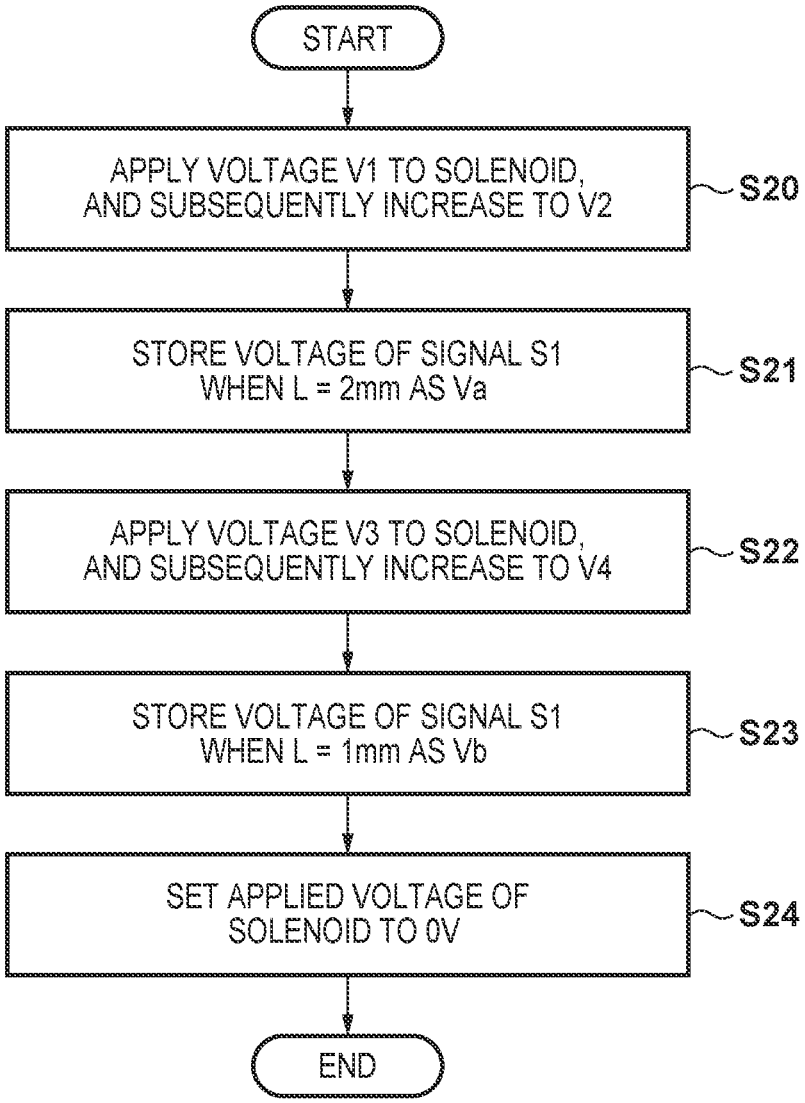
FIG. 12 is a flowchart of advance processing for sheet conveyance in accordance with an embodiment.

In the present embodiment, the processing of FIG. 12 is performed in advance, and the voltage of the signal S1 when the stroke L is 2 mm and the voltage of the signal S1 when the stroke L is 1 mm are respectively held in the storage unit 137 as Va and Vb. In a case of switching the switching flapper 120, the voltages Va and Vb held by the storage unit 137 are used. Explanation is given below regarding the processing of FIG. 12.

In step S20, the control unit 140 sets the applied voltage for the solenoid 130 to V1, which is 4V in the present example, and subsequently causes the applied voltage to increase to V2, which is 6V in the present example. In step S21, when it is detected that the plunger 131 has moved 1 mm in the upward direction of FIG. 1—in other words that the stroke L has become 2 mm, the control unit 140 stores the voltage of the signal S1 at that point as the voltage Va in the storage unit 137. In the present example, 0.625V is stored as Va, for example. Note that the applied voltage for the solenoid 130 at this point is 5V in accordance with Equation (1). Next, in step S22, the control unit 140 sets the applied voltage for the solenoid 130 to V3, which is 16V in the present example, and subsequently causes the applied voltage to increase to V4, which is 20V in the present example. In step S23, when it is detected that the plunger 131 has moved 1 mm in the upward direction of FIG. 1—in other words that the stroke L has become 1 mm, the control unit 140 stores the voltage of the signal S1 at that point as the voltage Vb in the storage unit 137. In the present example, 2.25V is stored as Vb, for example. Note that the applied voltage for the solenoid 130 at this point is 18V in accordance with Equation (1). Subsequently, in step S24, the control unit 140 sets the applied voltage for the solenoid 130 to 0, and by this the switching flapper 120 returns to the initial state. Note that the processing of FIG. 12 can be performed each time a predetermined condition is satisfied, irrespective of the processing of FIG. 13 which is explained below, and can be executed directly before the processing of FIG. 13. In any case, in the processing of FIG. 13 which is explained below, the control unit 140 uses the voltages Va and Vb obtained by the processing of FIG. 12 that was last performed.

Figure 13:
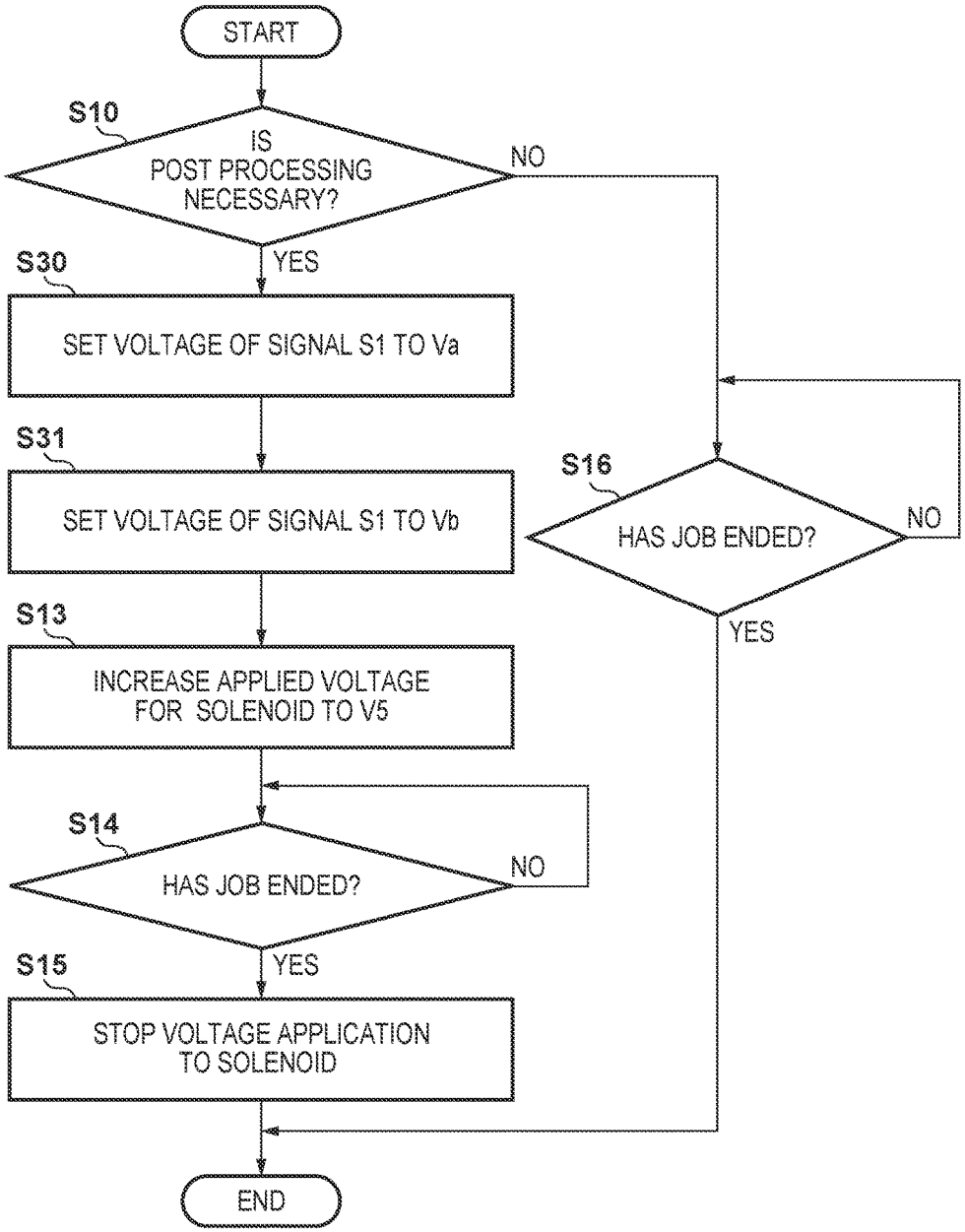
FIG. 13 is a flowchart for sheet conveyance processing in accordance with an embodiment.
Figure 14:
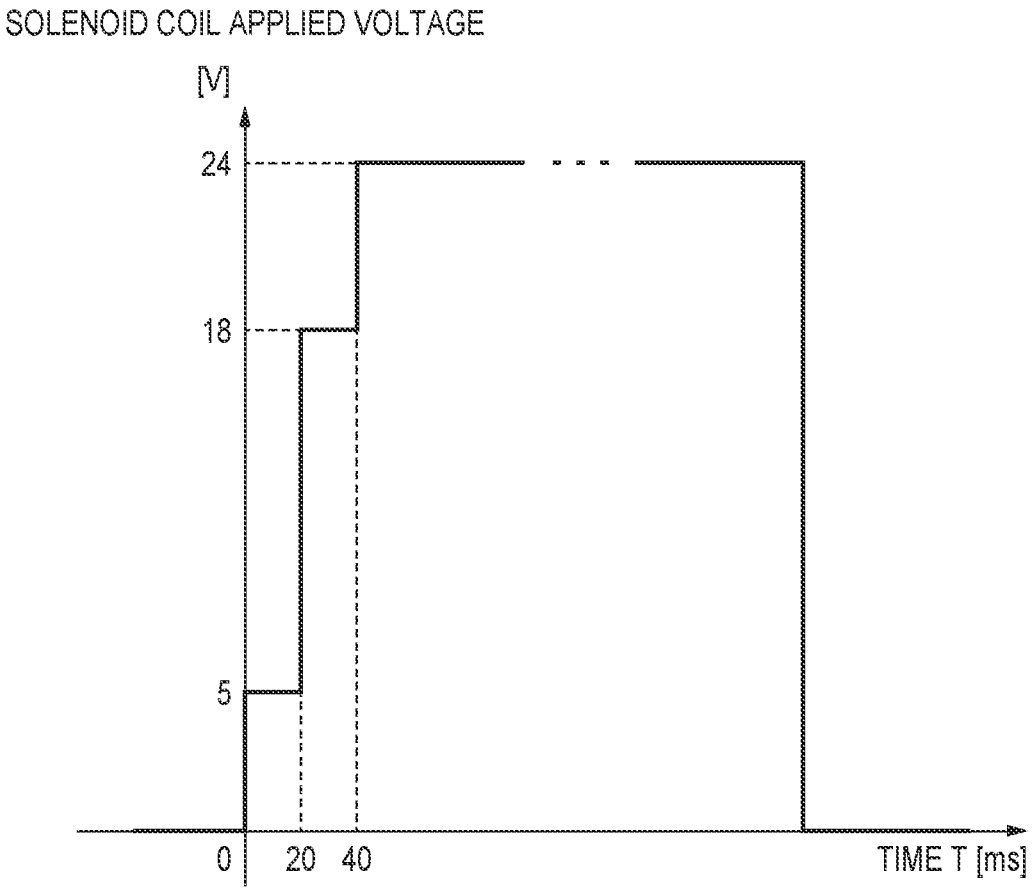
FIG. 14 is a view that illustrates an applied voltage for a solenoid in the sheet conveyance processing in accordance with an embodiment.

Upon receiving a print job from a user, the image forming apparatus 100 starts the processing illustrated in FIG. 13. Note that, in the flowchart of FIG. 13, processing portions that are the same as those in the flowchart of FIG. 6, which relates to the first embodiment, use the same reference codes, and explanation thereof is omitted. In the present embodiment, if post processing is necessary in step S10, the control unit 140, in step S30, sets the voltage of the signal S1 to Va. That is, it sets the applied voltage for the solenoid to 5V. Accordingly, the second link member 133 transitions from the state of FIG. 2A to the state of FIG. 2B and stops. When 20 ms which is necessarily sufficient for the stroke L to change by 1 mm elapses, the control unit 140, in step S31, sets the voltage of the signal S1 to Vb. That is, it sets the applied voltage for the solenoid to 18V. Accordingly, the second link member 133 transitions from the state of FIG. 2B to the state of FIG. 3 and stops. Subsequent processing is the same as that in the first embodiment. FIG. 14 illustrates the relation between time and the applied voltage for the solenoid 130 that was explained with reference to FIG. 13.

In the present embodiment, a relation between a movement amount of the plunger 131 and the load of the solenoid 130—in other words the minimum force necessary to move the second link member 133—is actually measured. Accordingly, it ceases to be necessary to consider, for example, variation due to individual differences in a force necessary to move the second link member 133 or a force necessary to press the switching flapper 120 down. Accordingly, it is possible to switch the solenoid 130 in a shorter time in comparison to the first embodiment. In addition, it is possible to have a configuration in which the displacement sensor 136 is not provided in the image forming apparatus 100, but provided in a load inspection tool at a factory, and the voltage Va and the voltage Vb at the time of a load inspection in the factory are stored in the storage unit 137. In this case, it ceases to be necessary to provide the displacement sensor 136 in each image forming apparatus 100, and it is possible to suppress cost.

Third Embodiment

Figure 15:
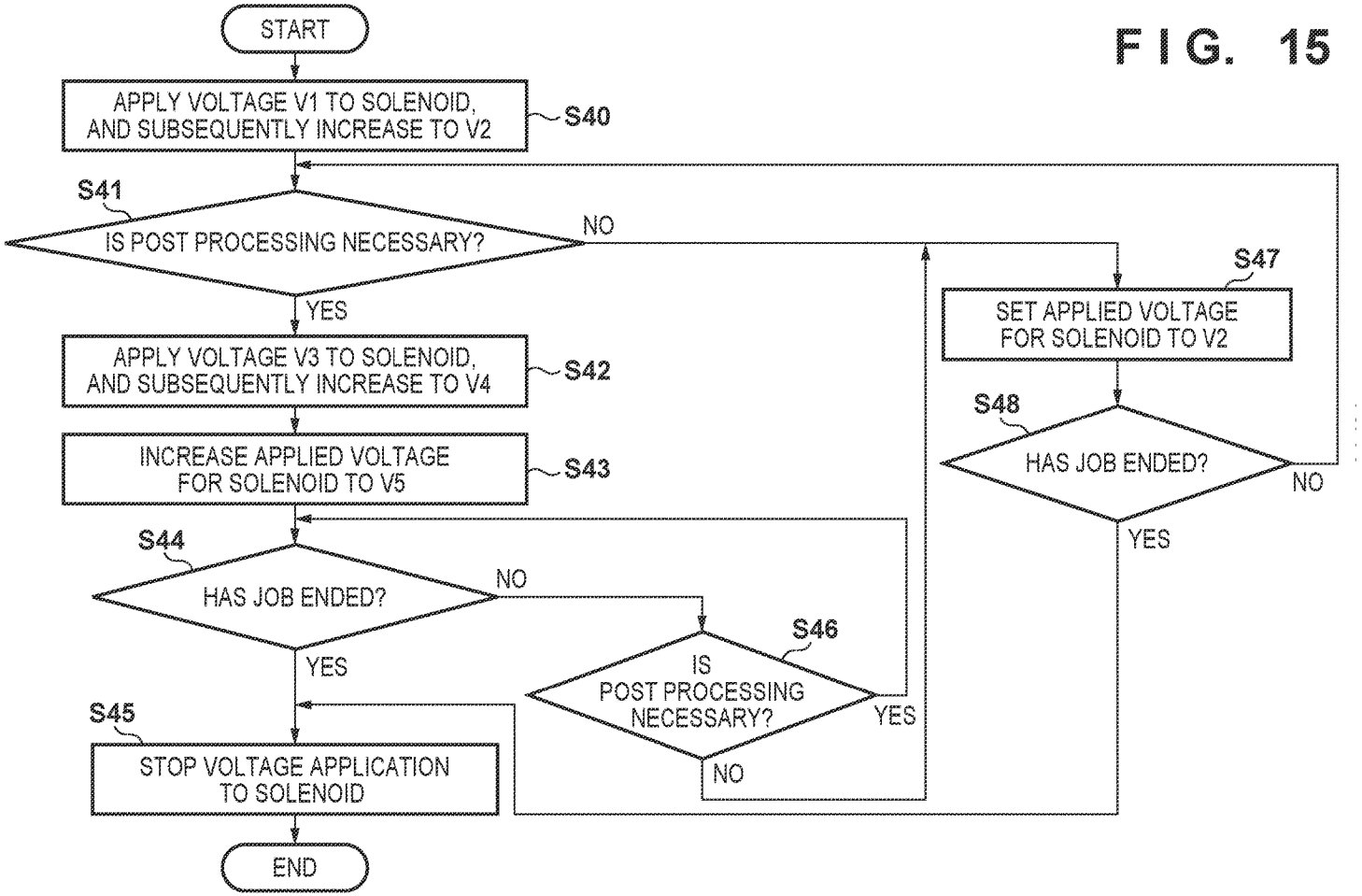
FIG. 15 is a flowchart for sheet conveyance processing in accordance with an embodiment.

Subsequently, description is given regarding the third embodiment focusing on points of difference with the first embodiment. In the first embodiment, sheets onto which images were formed in one print job either all needed post processing or all did not need post processing. In the present embodiment, explanation is given for a case in which sheets needing post processing and sheets that do not need post processing are mixed in a print job. FIG. 15 is a flowchart according to this embodiment. Upon receiving a print job, the control unit 140 first performs the processing of step S40. Step S40 is the same as the processing of step S11 of the first embodiment, and accordingly the second link member 133 enters the state of FIG. 2B. Subsequently, in step S41, the control unit 140 determines whether the sheet 10 currently being conveyed needs post processing. When post processing is necessary, the control unit 140 performs the processing of step S42 and step S43. The processing of step S42 and step S43 is the same as the processing of step S12 and step S13 of the first embodiment, and the second link member 133 enters the state of FIG. 3, and the switching flapper enters the state A.

In step S44, the control unit 140 determines whether the print job has ended, and, when it has ended, in step S45 the control unit 140 stops the voltage application to the solenoid to end processing. By stopping the voltage application to the solenoid, the switching flapper 120 returns to the state B. Meanwhile, if the print job has not ended in step S44, the control unit 140, in step S46, determines whether the sheet 10 currently being conveyed needs post processing. While sheets 10 that need post processing are consecutive, the control unit 140 repeats the processing from step S44. In other words, the switching flapper 120 remains in the state A.

Meanwhile, when a sheet that does not need post processing comes, the control unit 140, in step S47, sets the applied voltage for the solenoid to V2 (6V). The stroke L at this point in time is 1 mm, but by setting the applied voltage to V2, the attraction P of the solenoid becomes smaller than 6N. Accordingly, the switching flapper 120 is pushed and returned by the spring 134 and the self weight of the plunger 131, and enters the state of FIG. 2B. Accordingly, the switching flapper 120 enters the state B. Subsequently, in step S48, the control unit 140 determines whether the print job has ended, and, when it has ended, in step S45 the control unit 140 stops the voltage application to the solenoid to end processing. Meanwhile, if the print job has not ended, the processing from step S41 repeats.

Figure 2B:
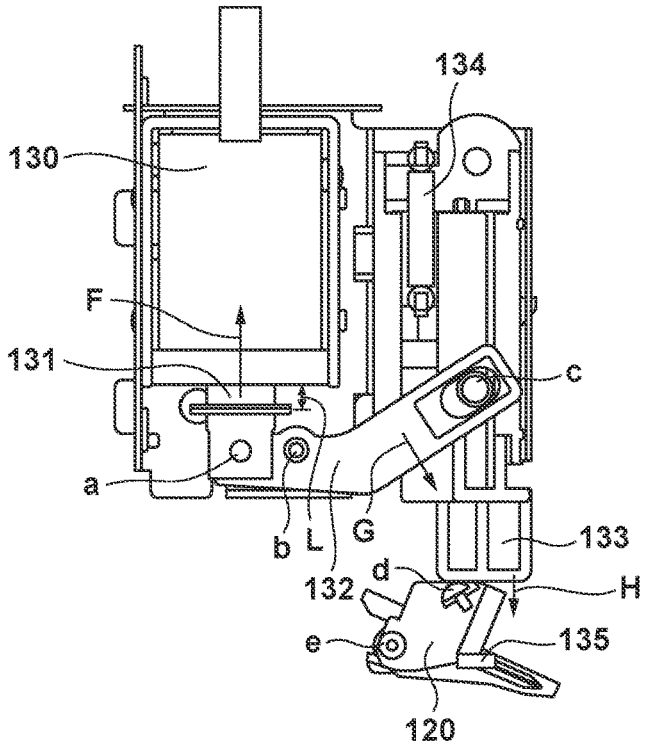

In the present embodiment, in a case of directing the sheet 10 to the conveyance path B, setting is made to enter the state illustrated in FIG. 2B instead of the state illustrated in FIG. 2A. Accordingly, it is possible to further shorten the time required to switch the switching flapper 120 from the state B to the state A.

Note that, in all of the above embodiments, the force, in other words a load, necessary to cause the plunger 131, the first link member 132, and the second link member 133—(transfer members)—to move when switching the switching flapper 120 from the state A to the state B changes once. However, there is no limitation to changing the force necessary to cause the transfer member to move only once, and it is similar even when changing the force a plurality of times. Specifically, it is assumed that the transfer member is caused to move from a first position to a second position when switching the switching flapper 120 from the state A to the state B. It is assumed that one or more load change positions for changing the force necessary to move the transfer member are present between the first position and the second position. In addition, assume that a force necessary to move the transfer member from the first position to an initial load change position is A1, and assume that a force necessary to move the transfer member from the initial load change position to a next load change position is A2. In this case, when moving the transfer member from the first position to the initial load change position, the control unit 140 first sets the attraction of the solenoid 130 to a value smaller than A1, and subsequently causes the attraction of the solenoid 130 to increase to a value larger than A1. When the transfer member reaches the initial load change position, the control unit 140 sets the attraction of the solenoid 130 to a value smaller than A2, and subsequently causes the attraction of the solenoid 130 to increase to a value larger than A2. By similarly repeating this, it is possible to suppress mechanical noise that accompanies operation of the switching flapper 120. Note that it is similar even in a case where load change points are not present. In addition, explanation was given with a configuration in which there is a possibility that a collision sound will occur when causing the attraction of the solenoid 130 to increase, but it is possible to similarly apply concepts in the embodiments described above even with a configuration in which there is a possibility that a collision sound will occur when causing the attraction of the solenoid 130 to decrease.

OTHER EMBODIMENTS

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-007004, filed on Jan. 18, 2017, which is hereby incorporated by reference herein in its entirety.

What is claimed is:

1. A sheet conveyance apparatus, comprising:

a guide member configured to guide a sheet in a first direction in a first state, and guide the sheet in a second direction in a second state;

a driving source configured to generate a driving force for changing a state of the guide member from the first state to the second state;

a transfer member configured to change the state of the guide member from the first state to the second state by being moved by the driving force generated by the driving source; and a control unit configured to control the driving force of the driving source, wherein the control unit is further configured to set the driving force of the driving source to a value smaller than a force necessary to move the transfer member and greater than zero when the guide member is in the first state, and subsequently cause the driving force of the driving source to increase to a value larger than the force necessary to move the transfer member when the guide member is in the first state.

2. The sheet conveyance apparatus according to claim 1, wherein the control unit is further configured to cause the driving force of the driving source to increase continuously or to cause the driving force of the driving source to increase in units of a predetermined value.

3. The sheet conveyance apparatus according to claim 1, wherein the transfer member is moved from a first position to a second position in order to change the guide member from the first state to the second state, a force necessary to move the transfer member from the first position is a first value, and the control unit is further configured to set the driving force of the driving source to a second value smaller than the first value when moving the transfer member from the first position, and subsequently cause the driving force of the driving source to increase to a third value larger than the first value.

4. The sheet conveyance apparatus according to claim 3, further comprising a holding unit configured to hold the second value and the third value.

5. The sheet conveyance apparatus according to claim 3, wherein one or more load change positions are present between the first position and the second position, and the force necessary to move the transfer member changes at the one or more load change positions, a force necessary to move the transfer member from the first position to an initial load change position is the first value, a force necessary to move the transfer member from the initial load change position to a next load change position or the second position is a fourth value larger than the first value, and the control unit is further configured to, after causing the driving force of the driving source to increase from the second value to the third value, move the transfer member by the third value to the initial load change position, set the driving force of the driving source to a fifth value smaller than the fourth value when the transfer member reaches the initial load change position, and subsequently cause the driving force of the driving source to increase to a sixth value greater than the fourth value.

6. The sheet conveyance apparatus according to claim 5, wherein the fifth value is larger than the third value.

7. The sheet conveyance apparatus according to claim 3, wherein the transfer member is moved from the first position to the second position via a third position, the guide member is in the first state when the transfer member is at the first position and the third position, and the guide member is in the second state when the transfer member is at the second position, the force necessary to move the transfer member is increased at the third position, and the control unit is further configured to set the driving force of the driving source so that the transfer member reaches the third position when guiding the sheet in the first direction, and set the driving force of the driving source so that the transfer member reaches the second position when guiding the sheet in the second direction.

8. The sheet conveyance apparatus according to claim 7, wherein a force necessary to move the transfer member from the third position to the second position is a fourth value larger than the first value, and the control unit is further configured to set the driving force of the driving source to a value smaller than the fourth value and larger than the first value when causing the transfer member to move from the second position to the third position, and increase the driving force of the driving source to a value larger than the fourth value when causing the guide member to move from the third position to the second position.

9. The sheet conveyance apparatus according to claim 1, wherein the driving source is a solenoid, and the control unit is further configured to control the driving force of the driving source in accordance with an applied voltage for the solenoid.

10. The sheet conveyance apparatus according to claim 1, further comprising a first conveyance path for conveying the sheet in the first direction, and a second conveyance path for conveying the sheet in the second direction, wherein the guide member is a flapper for switching a conveyance direction of the sheet.

11. A sheet conveyance apparatus, comprising:

a guide member configured to guide a sheet in a first direction in a first state, and guide the sheet in a second direction in a second state;

a driving source configured to generate a driving force for changing a state of the guide member from the first state to the second state;

a transfer member configured to change the state of the guide member from the first state to the second state by being moved by the driving force generated by the driving source;

a control unit configured to control the driving force of the driving source; and a measurement unit configured to measure a movement amount of the transfer member, wherein the control unit is further configured to, by measuring the movement amount of the transfer member while changing the driving force of the driving source, determine a relation between the movement amount of the transfer member and a load of the driving source.

12. The sheet conveyance apparatus according to claim 11, wherein the control unit is further configured to control the driving force of the driving source based on the relation between the determined movement amount of the transfer member and the load of the driving source.

13. An image formation apparatus, comprising:

a sheet conveyance apparatus, and an image forming unit configured to form an image on a sheet conveyed by the sheet conveyance apparatus, wherein the sheet conveyance apparatus comprises:

a guide member configured to guide a sheet in a first direction in a first state, and guide the sheet in a second direction in a second state;

a driving source configured to generate a driving force for changing a state of the guide member from the first state to the second state;

a transfer member configured to change the state of the guide member from the first state to the second state by being moved by the driving force generated by the driving source; and a control unit configured to control the driving force of the driving source, wherein the control unit is further configured to set the driving force of the driving source to a value smaller than a force necessary to move the transfer member and greater than zero when the guide member is in the first state, and subsequently cause the driving force of the driving source to increase to a value larger than the force necessary to move the transfer member when the guide member is in the first state.

* * * * *